US005845178A

United States Patent [19]

Hazama et al.

[11] Patent Number: 5,845,178

[45] Date of Patent: Dec. 1, 1998

[54] CHARGING DEVICE HAVING A CHARGER ARRANGEMENT FRAME IN WHICH A DISCHARGE WIRE, COIL SPRING AND ELECTRODE ARE DISPOSED, FOR USE IN A COMPACT ELECTROPHOTOGRAPHIC IMAGE FORMING APPARATUS

[75] Inventors: Hiroyuki Hazama; Masaru Watanabe; Takashi Terada; Hirotsugu Ogawa, all of Osaka, Japan

[73] Assignee: Mita Industrial Co., Ltd., Japan

[21] Appl. No.: 815,086

[22] Filed: Mar. 11, 1997

[30] Foreign Application Priority Data

Mar. 13, 1996 [JP] Japan ..... 8-056495

[51] Int. Cl.[6] ..... G03G 15/02

[52] U.S. Cl. ..... 399/170; 361/225; 399/172

[58] Field of Search ..... 399/170–172, 399/115; 361/225; 250/324, 325

[56] References Cited

U.S. PATENT DOCUMENTS 4,320,957 3/1982 Brown et al. ..... 399/170

4,914,480 4/1990 Endo ..... 399/172

5,181,069 1/1993 Oleksinski et al. ..... 399/115

FOREIGN PATENT DOCUMENTS 64-88474 4/1989 Japan .

*Primary Examiner*—William J. Royer

*Assistant Examiner*—Quana Grainger

*Attorney, Agent, or Firm*—Rabin & Champagne, P.C.

[57] ABSTRACT

A charging device is provided which is suitable for use in a compact electrophotographic image forming apparatus. The charging device includes: a pair of support members spaced a predetermined distance; and a discharge wire stretched between the pair of support members with one end thereof being fixed to one of the support members and with a middle portion thereof being supported by the other support member. One end of a coil spring is connected to the other end of the discharge wire, and the other end of the coil spring is received by a hooking portion of an electrode. The electrode is fixed in the vicinity of one of the support members.

5 Claims, 8 Drawing Sheets

CHARGING DEVICE HAVING A CHARGER ARRANGEMENT FRAME IN WHICH A DISCHARGE WIRE, COIL SPRING AND ELECTRODE ARE DISPOSED, FOR USE IN A COMPACT ELECTROPHOTOGRAPHIC IMAGE FORMING APPARATUS

BACKGROUND OF THE INVENTION

1. Field of the Invention

The present invention relates to a charging device for use in a compact electrophotographic image forming apparatus such as a compact printer.

2. Description of Related Art

In recent years, desk-top personal computers (PCs) have been in widespread use. For facilitation of printing of a PC-generated document and the like, a printer is preferably placed on a personal desk along with a PC. To this end, the size reduction of printers is desirable.

For personal use of an electrophotographic printer, it is essential to reduce the size of an image forming section thereof. For the size reduction of the image forming section, a need arises to reduce the size of a charging device for charging a photoreceptor.

In a charging device disclosed in Japanese Unexamined Patent Publication No. 64-88474, for example, one end of a tungsten discharge wire is fixed to a predetermined position of a case accommodating the charging device with a coil spring interposed therebetween. The application of a high voltage to the tungsten wire is achieved by contacting an output terminal of a high voltage source with a middle portion of the coil spring. This literature states that a single component, i.e., the coil spring, is employed for the voltage application and tension application to the tungsten wire, thereby reducing the size of the charging device.

The disclosed charging device, however, requires a component for fixing the coil spring to the case, thereby requiring a space for accommodating the component. The space requirement prevents the size reduction of the device. Therefore, the prior-art charging device does not necessarily meet the demand for the size reduction.

SUMMARY OF THE INVENTION

It is an object of the present invention to provide a charging device suitable for use in a compact electrophotographic image forming apparatus.

The charging device according to the present invention comprises: a pair of support members spaced a predetermined distance; a discharge wire stretched between the pair of support members with one end thereof being fixed to one of the support members and with a middle portion thereof being supported by the other support member; a coil spring for applying a tension to the discharge wire, one end thereof being connected to the other end of the discharge wire; an electrode having a hooking portion for receiving the other end of the coil spring; and an electrode fixing member for fixing the electrode in the vicinity of the other support member.

By engaging the coil spring to a discharge wire hooking portion, the discharge wire is stretched at a predetermined tension between the pair of support members, and the electrode is connected to the electrode fixing member.

With this arrangement, the coil spring serves to stretch the discharge wire and to connect the electrode to the electrode fixing member. Therefore, there is no need to separately provide components for fixing the discharge wire and for fixing the electrode, requiring no space for accommodating these components for attachment thereof. In addition, the ends of the coil spring are respectively connected to the discharge wire and the electrode and, hence, no special component for fixing the coil spring is required. Thus, the size reduction of the device can be realized. Further, the number of components constituting the device is reduced, so that a less expensive image forming apparatus can be provided.

The electrode fixing member may be an electrode fixing plate provided on a bottom of a charging device frame and having an opening. In such a case, the electrode preferably has a base portion abutting against the electrode fixing plate and an insertion portion provided upright on the base portion and inserted into the opening, and the hooking portion is preferably provided at a tip of the insertion portion.

Electrode fixing plates each having an opening may respectively be provided in the vicinity of the pair of support members. In such a case, the pair of support members may respectively be provided upright on edges of the electrode fixing plates.

The charging device frame may include a charger arrangement frame in which the discharge wire, the coil spring and the electrode are disposed and a brush holder to which a brush member is attached, the charger arrangement frame and the brush holder being integrally formed in an adjoining relation.

In such a case, the brush holder preferably has a retention space for receiving an attachment plate portion of the brush member inserted therein, and a plurality of protrusions extending parallel to a direction of the insertion of the attachment plate portion and arranged across the direction of the insertion of the attachment plate along extension of the discharge wire to face the retention space.

The foregoing and other objects, features and effects of the present invention will become apparent from the following description of the preferred embodiments with reference to the attached drawings.

DETAILED DESCRIPTION OF THE PREFERRED EMBODIMENTS

Figure 1:
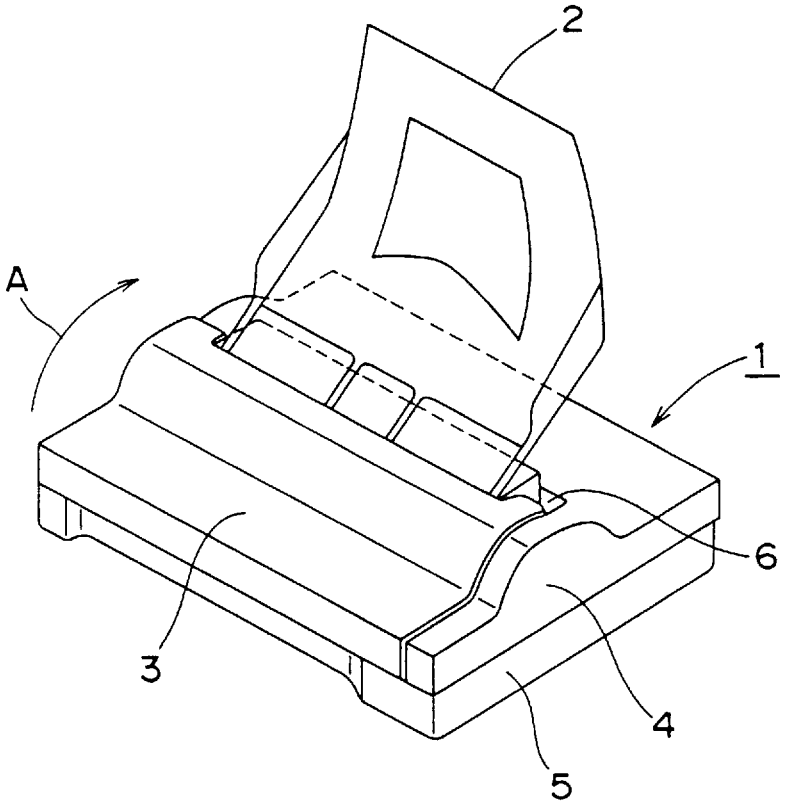
FIG. 1 is a perspective view schematically illustrating the appearance of printer having a charger in accordance with one embodiment of the present invention.
Figure 2:
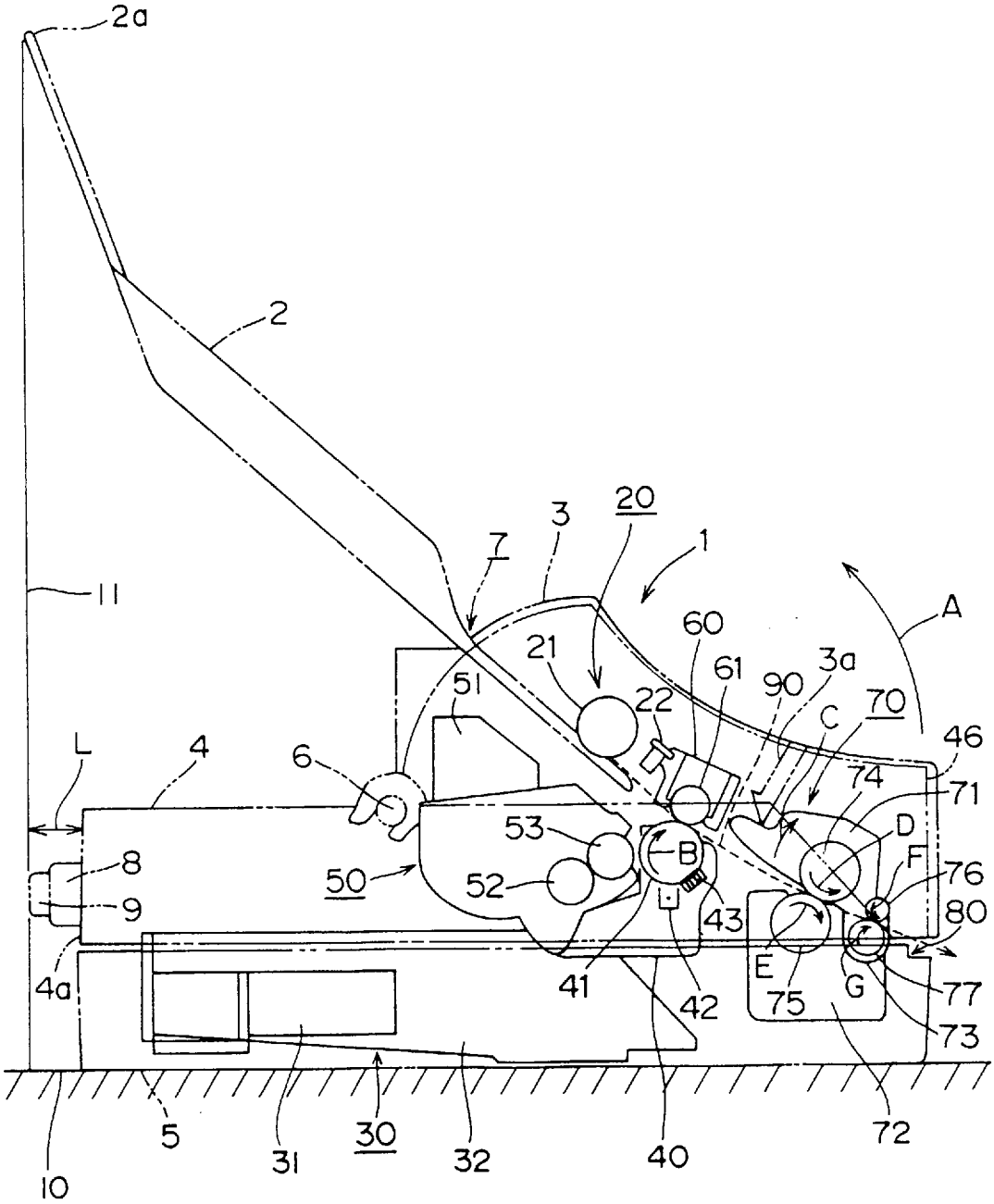
FIG. 2 is a diagram illustrating the inner construction of the printer as viewed from the left side thereof when its cover is closed.
Figure 3:
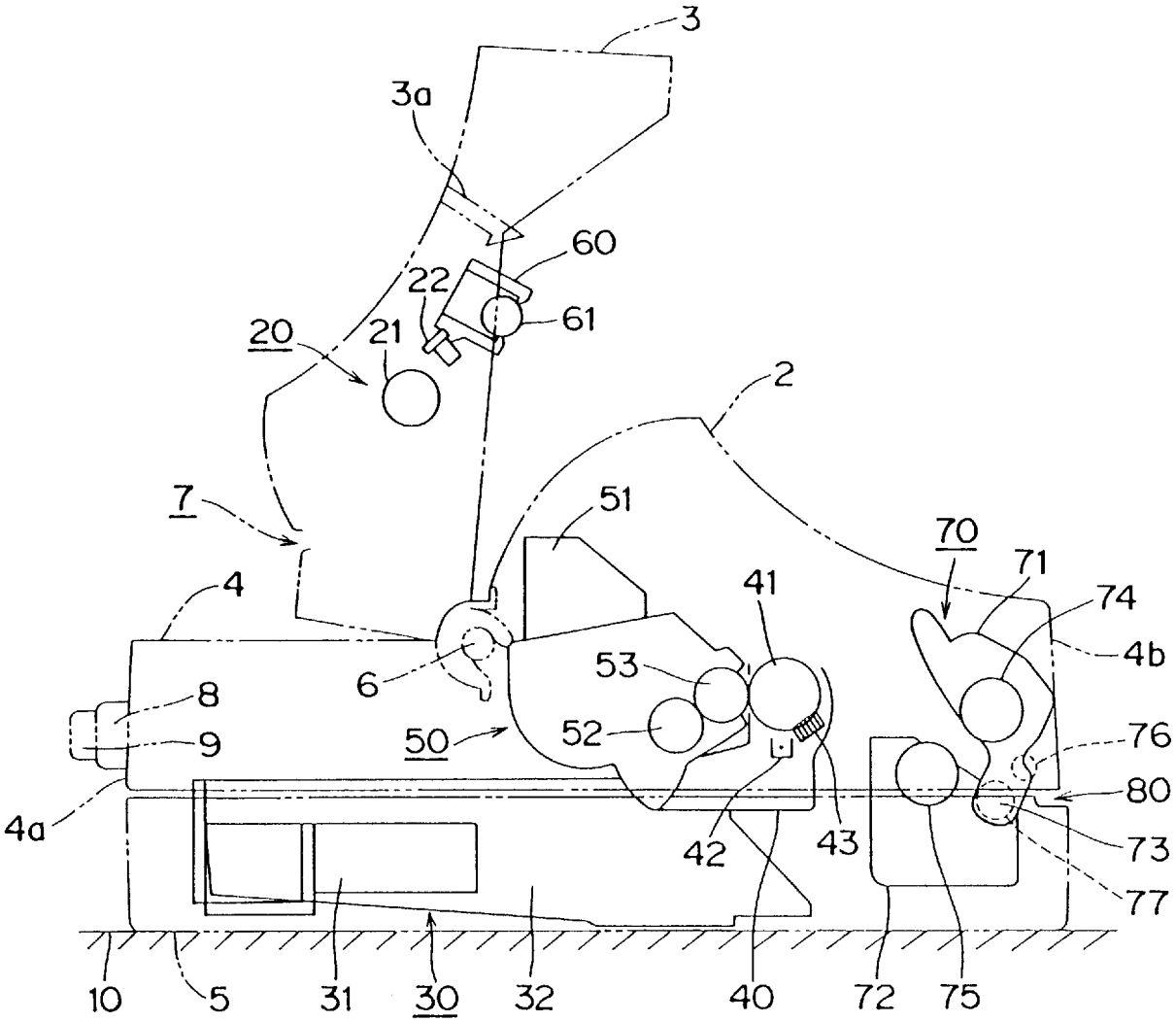
FIG. 3 is a diagram illustrating the inner construction of the printer as viewed from the left side thereof when its cover is opened.

FIG. 1 is a perspective view schematically illustrating the appearance of a printer having a charger in accordance with one embodiment of the present invention. FIGS. 2 and 3 are diagrams illustrating the inner construction of the printer as viewed from the left side thereof. In FIGS. 2 and 3, the outline of the printer is shown by a phantom line for emphasis of the inner construction thereof.

First, the features and appearance of the printer will be described. The printer is typically placed on a desk for personal use. The printer is connected to a personal computer (PC) or the like for ready print out of PC-generated documents, spreadsheets and the like.

As shown in FIGS. 1 to 3, the printer includes a main body 1 and a sheet feeding tray 2. The main body 1 has an openable cover 3, and upper and lower housings 4 and 5 fitted to each other to define the exterior thereof. The sheet feeding tray 2 accommodates printing sheets placed thereon, and is detachable from the main body 1.

As shown in FIGS. 1 to 3, the cover 3 is attached to the main body 1 to cover an upper front portion of the printer. The cover 3 is movable about a support point 6 in a direction of an arrow A from the front side to the rear side of the printer for the opening thereof. An open state of the cover 3 is shown in FIG. 3. When the cover 3 is to be opened, the sheet feeding tray 2 is preferably detached from the main body The cover 3 has a tray insertion slit 7 formed in a rear side portion thereof. The sheet feeding tray 2 is inserted into and drawn out of the tray insertion slit 7 for attachment and detachment thereof.

A connector 8 is provided on the rear face 4*a* of the upper housing 4. The connector 8 serves for the connection of the printer to a PC or the like. More specifically, a printer cable 9 is connected to the PC at one end thereof and to the connector 8 at the other end thereof.

As can be seen from FIGS. 2 and 3, the connector 8 and the printer cable 9 project from the rear face 4*a* of the upper housing 4. The length L of the projection depends on the kinds of the connector 8 and the printer cable 9 to be used.

The sheet feeding tray 2, when inserted into the tray insertion slit 7, obliquely extends upward from the main body 1 to the rear side as shown in FIGS. 1 and 2. The sheet feeding tray 2 has such dimensions that an upper edge 2*a* of the sheet feeding tray 2 attached to the main body 1 projects by a predetermined distance from the rear face 4*a* of the upper housing 4. More specifically, a projection 11 of the upper edge 2*a* of the sheet feeding tray 2 on a printer installation surface 10 is located apart from the rear face 4*a* of the upper housing 4 by a distance equivalent to the length L of the projection of the connector 8 and the printer cable 9.

Although the projection length L varies depending on the kinds of the connector 8 and the printer cable 9 to be used as described above, the size and configuration of the sheet feeding tray 2 is designed in consideration of a possible maximum projection length.

When the printer is to be installed with the rear face thereof being aligned parallel to a wall behind, for example, an installation service person places the printer in such a manner that the upper edge 2*a* of the sheet feeding tray 2 is aligned with the wall, thereby preventing the connector 8 and the printer cable 9 from abutting against the wall. This allows the service person to perform the installation operation more easily, and prevents a damage to the connector 8.

In addition, the projection 11 of the upper edge 2*a* on the printer installation surface 10 is located apart from the rear face 4*a* of the upper housing 4 only by the distance substantially equivalent to the length L of the projection of the connector 8 and the printer cable 9, as described above. Therefore, the requirement for the reduction in the installation space can be satisfied.

Next, the inner construction of the printer will be described with reference to FIGS. 2 and 3.

As shown in FIGS. 2 and 3, the printer has a sheet feeding portion 20, a laser emitting unit 30, an imaging unit 40, a developing unit 50, a transfer unit 60 and a fixing unit 70. An output port 80 is formed along an interface between the upper housing 4 and the lower housing 5 in a front face of the printer.

A sheet from the sheet feeding tray 2 is conveyed along a transportation path 90 indicated by a broken line through the sheet feeding portion 20, the imaging unit 40, the transfer unit 60 and the fixing unit 70 in the main body 1, and outputted from the output port 80. As shown in FIG. 2, the transportation path 90 linearly extends at a downward gradient from the sheet feeding tray 2 to the output port 80. This arrangement is optimal to reduce the size of the printer.

The sheet feeding portion 20 sends out a sheet from the sheet feeding tray 2 to the transportation path 90 in the main body 1. The sheet feeding portion 20 is fixed to the cover 3, and lifted along with the cover 3 when the cover 3 is opened.

The sheet feeding portion 20 has a sheet feeding roller 21. The sheet feeding roller 21 is provided in such a position as to abut against a surface portion of the sheet feeding tray 2 when the sheet feeding tray 2 is inserted into the tray insertion slit 7.

The sheet feeding portion 20 further has a sheet sensor switch 22. The sheet sensor switch 22 senses the presence of a sheet for sheet feeding control, and is provided immediately downstream of the sheet feeding roller 21 in the transportation path 90. The sheet feeding control is achieved in the following manner.

When an instruction is given to start the sheet feeding in a state where sheets are placed on the sheet feeding tray 2, the sheet feeding roller 21 starts rotating. Thus, one of the sheets is fetched by the sheet feeding roller 21 and sent out to the transportation path 90. After a lapse of a first predetermined period from the start of the rotation of the sheet feeding roller 21, the sheet reaches the sheet sensor switch 22, thereby turning on the sheet sensor switch 22.

The rotation of the sheet feeding roller 21 is stopped after a lapse of a second predetermined period from the turn-on of the sheet sensor switch 22. The second period is set to be sufficient for the fed sheet to reach the fixing unit 70. Upon reaching the fixing unit 70, the sheet is conveyed by the fixing unit 70 to be outputted. When the next sheet is to be fed, the sheet feeding roller 21 is rotated again after a lapse of a predetermined period from the stop of the rotation thereof.

If the sheet sensor switch 22 is not turned on within the first period after the start of the rotation of the sheet feeding roller 21, it is recognized that the sheets have run out.

The laser emitting unit 30 outputs a laser beam corresponding to an image signal. The laser emitting unit 30 is disposed in the lower housing 5 of the main body 1.

The laser emitting unit 30 has a laser source 31 and an optical system 32. The laser source 31 is comprised of a semiconductor laser and the like. The optical system 32, though not shown in detail, includes a plurality of reflector mirrors, lenses, a polygon mirror and the like. The laser beam generated by the laser source 31 is directed to the imaging unit 40 via the optical system 32.

The laser emitting unit 30 is electrically connected to the connector 8. The laser emitting unit 30 determines the intensity of the laser beam on the basis of image data applied thereto from the PC via the printer cable 9 and the connector 8. The laser source 31 generates a laser beam on the basis of the intensity of the laser beam thus determined.

The imaging unit 40, the developing unit 50 and the transfer unit 60 serve to form an image on the sheet supplied from the sheet feeding portion 20.

A photoreceptor 41 to be exposed to the laser beam is disposed in the imaging unit 40. A charger 42 and a paper dust collecting brush 43 are provided around the photoreceptor 41. Used as the photoreceptor 41 is a cylindrical photoreceptor of a reduced size, for example, having a diameter of 16 mm, for the size reduction of the printer.

During image formation, the photoreceptor 41 is rotated at a constant speed in a direction of an arrow B. After the surface of the photoreceptor 41 is uniformly charged at a predetermined high potential by means of the charger 42, the photoreceptor 41 is exposed to the laser beam from the laser emitting unit 30. Light-exposed portions of the photoreceptor 41 have a lower potential because electrical charge has escaped therefrom. As a result, an electrostatic latent image defined by higher potential portions and lower potential portions is formed on the surface of the photoreceptor 41.

The photoreceptor 41 is further rotated to bring the electrostatic latent image to the developing unit 50. Upon reaching the developing unit 50, the electrostatic latent image is developed into a toner image by the developing unit 50.

The developing unit 50 is provided in the upper housing 4, and includes a toner hopper 51, a subroller 52 and a developing roller 53. The toner hopper 51 contains a charged toner therein.

The subroller 52 and the developing roller 53 are respectively rotated in opposite directions. The toner in the toner hopper 51 is subjected to triboelectrification by the rotation of the subroller 52 and the developing roller 53, and electrostatically adsorbed around the developing roller 53. The subroller 52 serves for more efficient triboelectrification of the toner.

A predetermined bias voltage is applied between the subroller 52 and the developing roller 53. Thus, the toner adhering onto the peripheral surface of the developing roller 53 is electrostatically adsorbed only on the light-exposed portions of the surface of the photoreceptor 41. As a result, a toner image corresponding to the electrostatic latent image is formed on the surface of the photoreceptor 41.

The photoreceptor 41 is further rotated to bring the toner image to the transfer unit 60. Upon reaching the transfer unit 60, the toner image is transferred onto the sheet conveyed along the transportation path 90. More specifically, a transfer roller 61 is fitted in the transfer unit 60. When the leading edge of the toner image opposes the transfer roller 61, the leading edge of the sheet is inserted between the photoreceptor 41 and the transfer roller 61. Thus, the toner image formed on the photoreceptor 41 is transferred onto the sheet.

It is noted that the transfer unit 60 is fixed to the cover 3 and therefore is lifted along with the cover 3 when the cover 3 is opened.

Toner particles not transferred onto the sheet remain on the surface of the photoreceptor 41 after the transfer of the toner image. Since the sheet is brought into contact with the surface of the photoreceptor 41, paper dust from the sheet as well as the remaining toner particles adhere onto the photoreceptor 41.

When the photoreceptor 41 is rotated in contact with the paper dust collecting brush 43 in the imaging unit 40, the paper dust adhering onto the photoreceptor 41 is caught by tip portions of the paper dust collecting brush 43 for collection thereof. At this time, the remaining toner particles are scattered by the paper dust collecting brush 43, and electrostatic bonding between the remaining toner particles and the surface of the photoreceptor 41 is reduced in the toner remaining areas on the photoreceptor 41. The remaining toner particles with a reduced electrostatic bonding force are removed by means of the developing roller 53 in the next image forming operation.

After the image transfer, the sheet is supplied to the fixing unit 70. The fixing unit 70 serves to fix the toner image transferred onto the sheet, and is disposed in the transportation path 90 between the upper housing 4 and the lower housing 5.

The fixing unit 70 has an upper fixing unit portion 71 and a lower fixing unit portion 72. The lower fixing unit portion 72 is fixed to the lower housing 5. The upper fixing unit portion 71 is pivotally supported by a support point 73 for pivotal movement in a direction of an arrow C with respect to the lower fixing unit portion 72.

A space defined between the upper fixing unit portion 71 and the lower fixing unit portion 72 forms a portion of the transportation path 90, and generally linearly extends at a downward gradient from the sheet feeding tray 2 to the output port 80 as described above. The upper and lower unit portions 71 and 72 have an upper fixing roller 74 and a lower fixing roller 75, respectively. A heater (not shown) is fitted in the lower fixing roller 75 along an axis thereof.

When the cover 3 is closed, the fixing unit 70 is in a closed state as shown in FIG. 2. More specifically, the upper fixing unit portion 71 is pressed by a press portion 3*a* projecting from the interior surface of the cover 3. The upper fixing roller 74 is attached to the upper fixing unit portion 71 movably in a direction perpendicular to the axis thereof. The upper fixing roller 74 is always resiliently biased in a direction opposite to the direction of the arrow C. As a result, the upper fixing roller 74 is urged into contact with the lower fixing roller 75 at a predetermined pressure.

During the image formation, the cover 3 is closed. The upper fixing roller 74 is rotated in a direction of an arrow D, and the lower fixing roller 75 is rotated in a direction of an arrow E. After the image transfer, the sheet is supplied between the upper and lower fixing rollers 74 and 75 urged against each other. At this time, the lower fixing roller 75 is heated by the heater. Thus, the toner particles are melted by the heat and pressure, and fixed on the sheet.

When the cover 3 is opened, the urged state of the fixing unit 70 is eliminated as shown in FIG. 3. More specifically, the elimination of the urged state of the rollers 74 and 75 facilitates removal of a jammed sheet when the cover 3 is opened. At this time, the pivotal movement of the upper fixing unit portion 71 is restricted by a front face 4*b* of the upper housing 4.

The fixing unit 70 further has an upper output roller 76 and a lower output roller 77. More specifically, the upper output roller 76 is attached to the upper fixing unit portion 71 and adapted to rotate in a direction of an arrow F (see FIG. 2). The lower output roller 77 is attached to the lower fixing unit portion 72 and adapted to rotate in a direction of an arrow G (see FIG. 2). After the image fixation, the sheet is led to the output port 80 and outputted from the printer by the rotation of the output rollers 76 and 77.

The imaging unit 40 will be explained below in greater detail.

Figure 4:
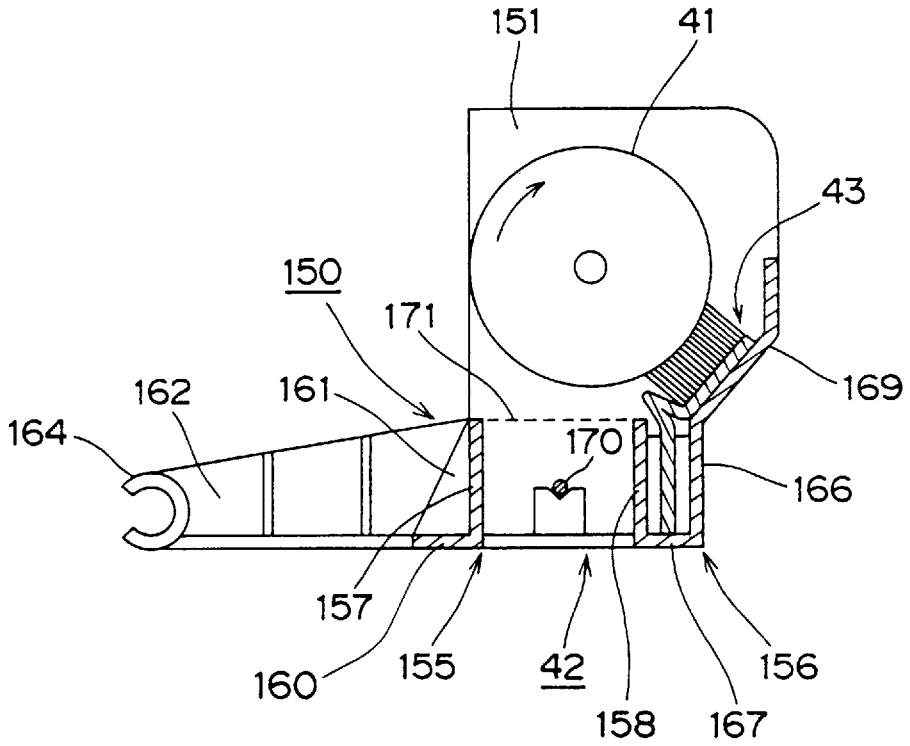
FIG. 4 is an enlarged sectional view illustrating an imaging unit of the printer as viewed from the left side thereof.

FIG. 4 is an enlarged sectional view illustrating the imaging unit 40 as viewed from the left side thereof.

As previously mentioned, the imaging unit 40 has the elongate cylindrical photoreceptor 41, which has a rotation axis extending perpendicular to the surface of FIG. 4. The charger 42 is disposed below the photoreceptor 41 in a parallel relation to the rotation axis thereof so as to face opposite to the peripheral surface thereof. The elongate paper dust collecting brush 43 extending parallel to the axis of the photoreceptor 41 is disposed upstream of the charger-photoreceptor opposing position with respect to the rotation direction of the photoreceptor 41 in contact with the peripheral surface of the photoreceptor 41. The photoreceptor 41, the charger 42 and the paper dust collecting brush 43 are supported by a single frame 150 molded, for example, from a resin.

Figure 5:
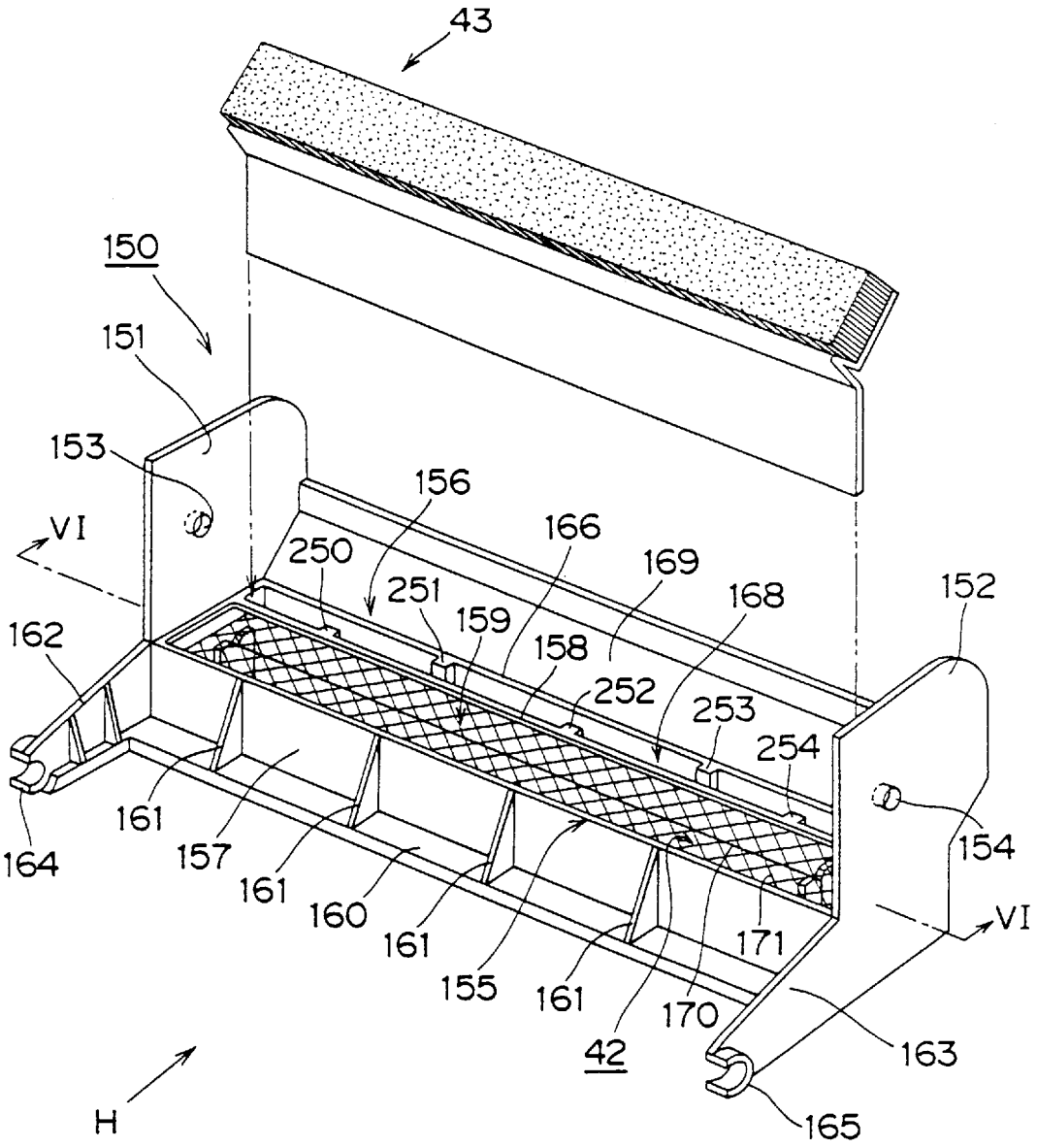
FIG. 5 is a perspective view illustrating the imaging unit as viewed at an angle from the left rear side for explaining the construction of a frame of the imaging unit.

FIG. 5 is a perspective view illustrating the imaging unit 40 as viewed at an angle from the left rear side. In the following description, expressions concerning positions and directions are based on the supposition that the imaging unit 40 is viewed from a side indicated by an arrow H in FIG. 5.

Referring to FIGS. 4 and 5, the frame 150 has a pair of side plates (left and right side plates) 151 and 152. The side plates 151 and 152 are formed with openings 153 and 154, respectively, for receiving the opposite end portions of a shaft of the photoreceptor 41. The left and right side plates 151 and 152 are connected by a charger arrangement frame 155, in which the charger 42 is disposed, and a brush holder 156 which holds the paper dust collecting brush 43.

More specifically, the charger arrangement frame 155 includes a rectangular front connection plate 157 having substantially the same length as the shaft of the photoreceptor 41 and a shared connection plate 158 spaced a predetermined distance from the front connection plate 157 in opposition thereto. The pair of side plates 151 and 152 are connected by the front connection plate 157 and the shared connection plate 158. The pair of side plates 151 and 152, the front connection plate 157 and the shared connection plate 158 cooperatively define a space 159 having a rectangular configuration in plan. Disposed in the space 159 is the charger 42, which includes a discharge wire 170 adapted to discharge when a predetermined high voltage is applied thereto and a grid 171 for controlling the potential of the discharge from the discharge wire 170.

The brush holder 156 is located behind the charger arrangement frame 155. The brush holder 156 is comprised of the connection plate 158 shared with the charger arrangement frame 155, a rear connection plate 166 spaced a predetermined distance from the shared connection plate 158 and a bottom plate 167 (see FIG. 4) connecting a lower edge of the shared connection plate 158 and a lower edge of the rear connection plate 166. A retention space 168 for holding the paper dust collecting brush 43 is defined within the brush holder 156 with its opposite sides covered with the side plates 151 and 152.

A support plate 169 obliquely extends from an upper edge of the rear connection plate 166 to the upper rear side. The support plate 169 supports the paper dust collecting brush 43 from the rear side thereof when the paper dust collecting brush 43 is held by the brush holder 156.

A plurality of vertically extending linear protrusions 250, 252 and 254 are formed on a face of the shared connection plate 158 opposed to the rear connection plate 166. Further, a plurality of linear protrusions 251 and 253 are formed on a face of the rear connection plate 166 opposed to the shared connection plate 158. The linear protrusions 250, 252 and 254 on the shared connection plate 158 and the linear protrusions 251 and 253 on the rear connection plate 166 are arranged in a staggered manner.

A rib base 160 horizontally extends forward from a lower edge of the front connection plate 157 of the charger arrangement frame 155 to a predetermined position. A plurality of ribs 161 for reinforcing the front connection plate 157 are provided to connect the rib base 160 and the front connection plate 157. The plurality of ribs 161 are arranged at predetermined intervals.

The side plates 151 and 152 are provided with unit fitting portions 162 and 163, respectively, which are formed integrally therewith and project forward therefrom. Engagement portions 164 and 165 each having a C-shaped cross section are formed at tips of the unit fitting portions 162 and 163, respectively, for engagement with a shaft provided in the main body of the printer.

As described above, the photoreceptor 41, the charger 42 and the paper dust collecting brush 43 are collectively held by the frame 150 and, hence, there is no need to provide separate components for attachment thereof in the main body of the printer. Thus, the size reduction of the printer can be realized. If the photoreceptor 41 and the paper dust collecting brush 43 are designed to have substantially the same service periods, the whole imaging unit 40 including the photoreceptor 41 and the paper dust collecting brush 43 can be replaced for user's convenience.

The photoreceptor 41 is preferably formed of an organic photoconductive material (OPC) which is positively charged by discharge from the charger 42. Thus, the surface of the photoreceptor 41 is uniformly charged, while generation of ozone is suppressed. This allows for formation of a high-quality image.

The respective components of the imaging unit 40 will next be described in greater detail.

Figure 6:
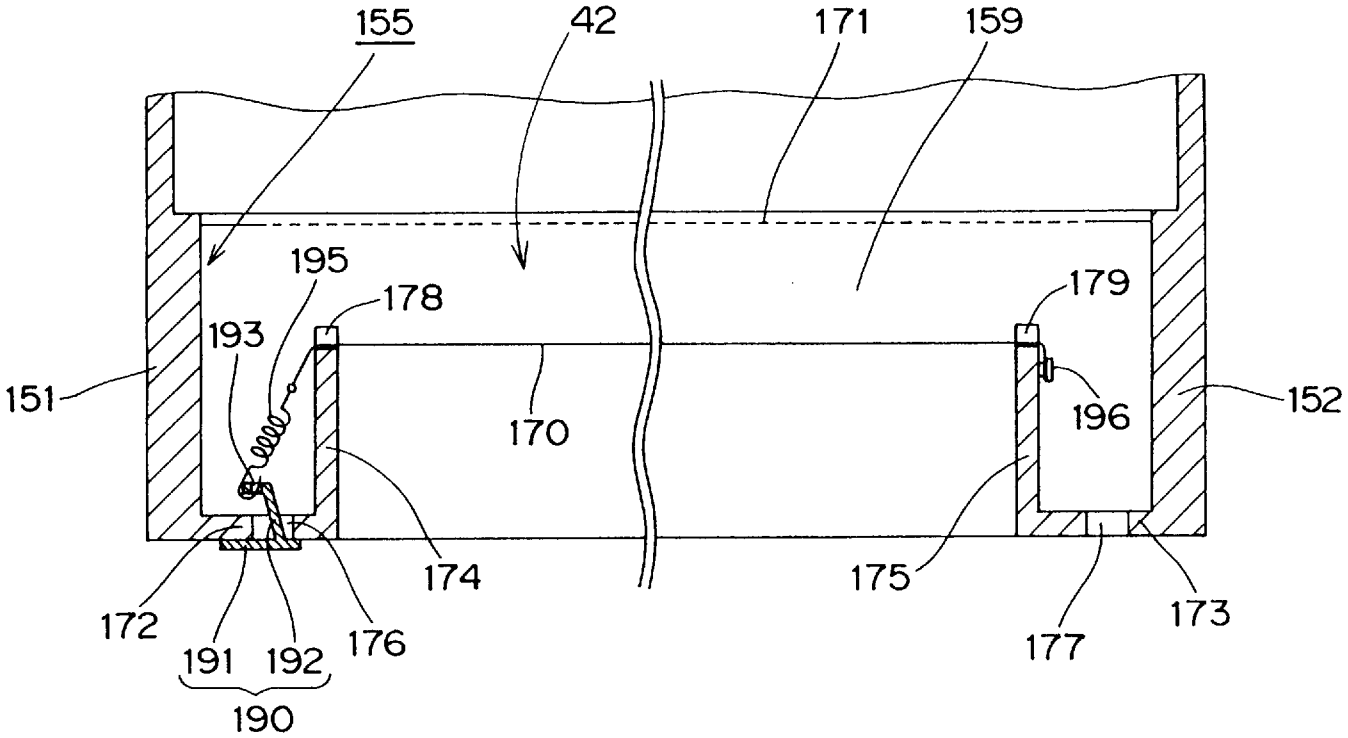
FIG. 6 is a sectional view taken along a VI—VI line in FIG. 5 for explaining the construction of the charger according to the embodiment.

FIG. 6 is a sectional view taken along a VI—VI line in FIG. 5. Referring to FIGS. 5 and 6, the charger 42 is disposed in the space 159 within the charger arrangement frame 155. The space 159 vertically extends through the charger arrangement frame 155.

First, an explanation will be given to the charger arrangement frame 155. An electrode fixing plate 172 extends rightward from the lower edge of the left side plate 151 to a predetermined position along the lower edges of the front connection plate 157 and the shared connection plate 158. A first wire support plate 174 for supporting the discharge wire 170 is disposed upright on an edge of the electrode fixing plate 172 in the space 159. An electrode fixing plate 173 extends leftward from the lower edge of the right side plate 152 to a predetermined position along the lower edges of the front connection plate 157 and the shared connection plate 158. A second wire support plate 175 is disposed upright on an edge of the electrode fixing plate 173. The first and second wire support plates 174 and 175 are spaced substantially the same distance as the length of the photoreceptor 41 in an opposed relation.

The wire support plates 174 and 175 respectively have cut-away portions 178 and 179 formed at middle portions of upper edges thereof for accepting the discharge wire 170. The electrode fixing plates 172 and 173 are formed with rectangular openings 176 and 177, respectively, at predetermined positions thereof.

The charger 42 is comprised of the discharge wire 170 for discharging when the predetermined high voltage is applied thereto, the grid 171 for controlling the potential of the discharge from the discharge wire 170, and an electrode 190 for applying the high voltage to the discharge wire 170.

The electrode 190 includes an electrode base portion 191 having a rectangular configuration in plan and an insertion portion 192 projecting upright from an upper face of the electrode base portion 191. The electrode base portion 191 and the insertion portion 192 are integrally formed of a conductive material such as a metal. The insertion portion 192 has generally an inverted L-shaped cross section, and is formed with a hooking hole 193 for receiving one end of a coil spring 195 at a predetermined position in a tip portion thereof.

The discharge wire 170 is stretched between the pair of wire support plates 174 and 175. The discharge wire 170 is supported in the cut-away portions 178 and 179 so that the discharge wire 170 is prevented from moving in a direction perpendicular to the surface of FIG. 6. One end of the discharge wire 170 is fixed to the wire support plate 175 by a screw 196, while the other end thereof is connected to the electrode 190 via the coil spring 195. The wire support plate 174 supports a middle portion of the discharge wire 170 in the vicinity of the other end thereof. The one end of the coil spring 195 is received by the hooking hole 193 formed in the insertion portion 192 of the electrode 190, while the other end thereof is connected to the other end of the discharge wire 170. The coil spring 195 is formed of a conductive material.

The electrode 190 is attached to the electrode fixing plate 172 in such a state that the insertion portion 192 is inserted into the charger arrangement frame 157 through the opening 176 from an under side of the electrode fixing plate 172 and an upper face of the electrode base portion 191 is brought in contact with the under face of the electrode fixing plate 172. The opening 176 has such dimensions as to permit the passage of the insertion portion 192 but not to permit the passage of the electrode base portion 191. That is, the electrode base portion 191 cannot enter the inside of the charger arrangement frame 157.

The discharge wire 170 and the electrode 190 are biased toward each other by the coil spring 195. Thus, a predetermined tension is applied to the discharge wire 170, while the electrode 190 is held by the electrode fixing plate 172. It is noted that the electrode 190 is connected to a high voltage source not shown for application of the high voltage to the discharge wire 170.

Thus, the tension application to the discharge wire 170 and the fixing of the electrode 190 to the electrode fixing plate 172 can be achieved simply by employing the coil spring 195. Accordingly, there is no need to provide an additional component such as a screw for fixing the electrode 190 and the discharge wire 170, requiring no space for accommodating the additional component for attachment thereof. In addition, the coil spring 195 is held between the discharge wire 170 and the electrode 190 with opposite ends thereof respectively connected to the discharge wire 170 and the electrode 190. Therefore, no special component is required for attachment of the coil spring 195. Thus, the size of the printer can be reduced. Further, the number of components constituting the charger is reduced, so that the cost of the printer can be reduced.

Although the electrode fixing plates 172 and 173 have the openings 176 and 177, respectively, it is not necessarily required to form an opening in each of the electrode fixing plates, but it is sufficient to form an opening in at least one of the electrode fixing plates to which the electrode is to be attached. Where the openings are formed in the respective electrode fixing plates, the electrode 190 can be attached to a more convenient one of the electrode fixing plates.

Figure 7:
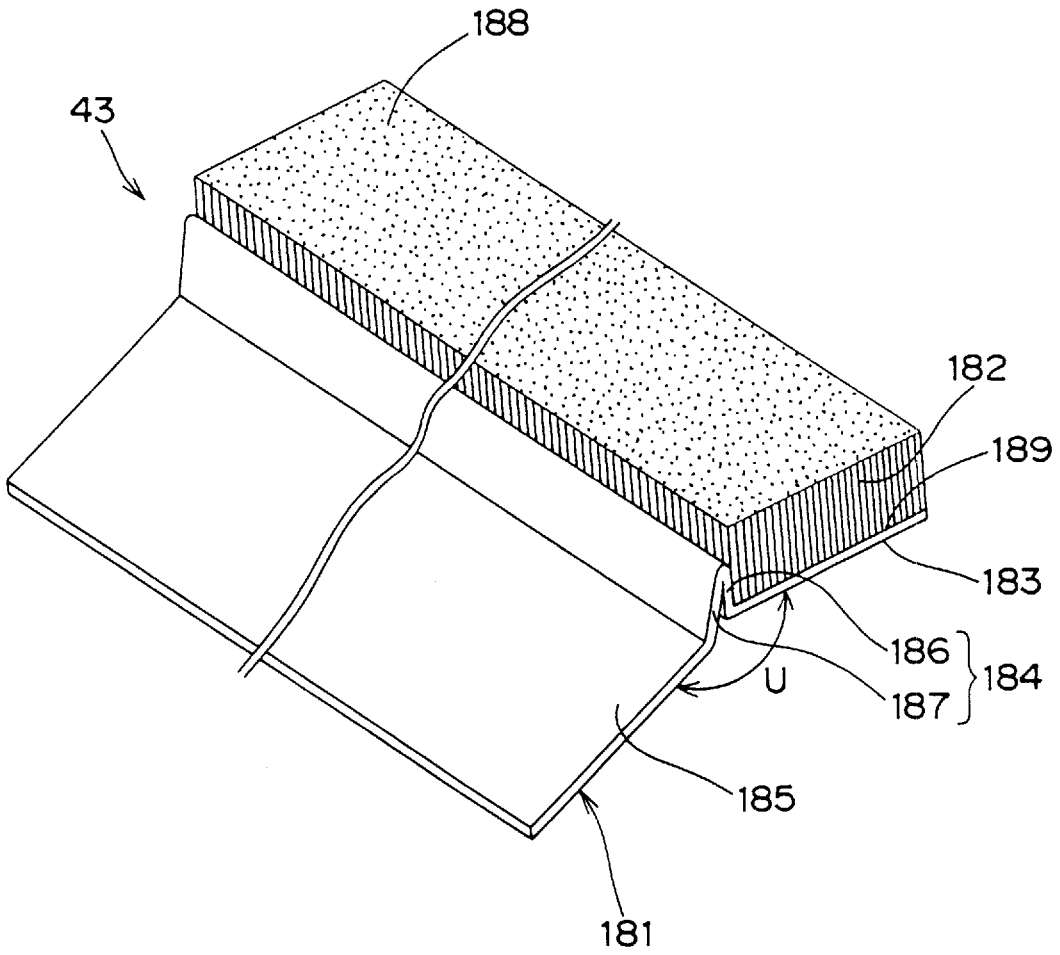
FIG. 7 is a perspective view for explaining the construction of a paper dust collecting brush.

FIG. 7 is a perspective view for explaining the construction of the paper dust collecting brush 43. Referring to FIGS. 5 and 7, the paper dust collecting brush 43 has a base 181 integrally formed, for example, of a thin metal plate. The base 181 includes a linear projection 184 of an inverted V cross section formed in a middle portion thereof and extending parallel to the axis of the photoreceptor 41. The base 181 is divided by the linear projection 184 into two portions: one is a plate portion 183 to which a brush material 182 is attached, and the other is an attachment plate portion 185 which is to be inserted into the brush holder 156.

More specifically, the plate portion 183 is rectangular in plan, and has an implantation surface 189 on which the brush material 182 is implanted. The linear projection 184 includes a rising portion 186 extending generally perpendicular to the implantation surface 189 from a longitudinal edge of the plate portion 183 to a predetermined altitude which is lower than the height of the brush material 182, and a falling portion 187 extending from an upper edge of the rising portion 186 in opposition to the rising portion 186. The rising portion 186 keeps the brush material 182 upstanding to prevent the brush material 182 from bending forward when the surface of the photoreceptor 41 is moved in contact with the brush material 182. Since the height of the linear projection 184 is smaller than that of the brush material 182, the linear projection 184 does not contact the peripheral surface of the photoreceptor 184.

The attachment plate portion 185 extends from a lower edge of the falling portion 187 in a direction intersecting the falling portion 187. Thus, the attachment plate portion 185 forms a predetermined angle U with respect to the plate portion 183. The predetermined angle U is such that the contact plane 188 of the brush material 182 in contact with the photoreceptor 41 coincides with a tangent of the photoreceptor 41 when the paper dust collecting brush 43 is held by the brush holder 156.

As described above, the linear projection 184 prevents the brush material 182 from bending along the tangent of the photoreceptor 41 due to the rotation of the photoreceptor 41. Since the base 181 is formed with the linear projection 184, the strength of the base 181 along the length thereof is increased to prevent the deformation of the plate portion 183 due to the rotation of the photoreceptor 41. Thus, the brush material 182 can be uniformly urged into contact with the peripheral surface of the photoreceptor 41.

Hence, the paper dust collecting brush 43 can efficiently brush away paper dust adhering onto the surface of the photoreceptor 41.

Figure 8:
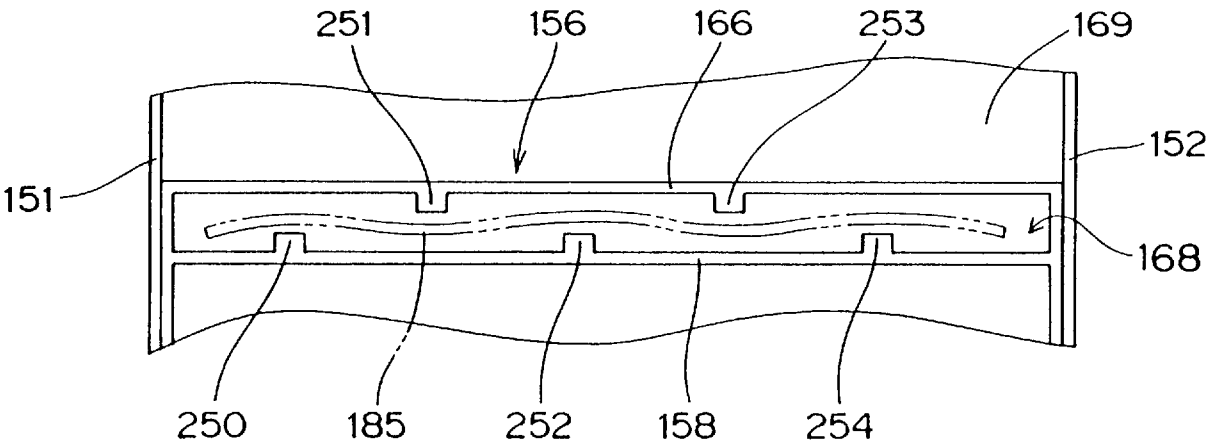
FIG. 8 is a plan view illustrating a state where the paper dust collecting brush is held by a brush holder.

FIG. 8 is a plan view illustrating a state where the paper dust collecting brush 43 is held by the brush holder 156. Referring to FIGS. 5 and 8, the brush holder 156 includes the retention space 168 which has a rectangular configuration extending parallel to the axis of the photoreceptor 141 as viewed from the top and is defined by the pair of side plates 151 and 152, the shared connection plate 158 and the rear connection plate 166. The retention space 168 receives the attachment plate portion 185 of the paper dust collecting brush 43 inserted therein to hold the paper dust collecting brush 43. The bottom portion of the retention space 168 is covered with a bottom plate 167.

The linear protrusions 250, 252 and 254 projecting perpendicular to the direction of the insertion of the paper dust collecting brush 43 are provided on the face of the shared connection plate 158 opposed to the rear connection plate 166. Further, the linear protrusions 251 and 253 are provided on the face of the rear connection plate 166 opposed to the shared connection plate 158. The linear protrusions 250 to 254 are alternately arranged on the shared connection plate 158 and the rear connection plate 166. In other words, the linear protrusions 250 to 254 are arranged in an unopposed manner, i.e., in a staggered manner. The linear protrusions 250 to 254 each face the retention space 168 and extend in the direction of the insertion of the attachment plate portion 185 of the paper dust collecting brush 43. The linear protrusions 250 to 254 are arranged across the direction of the insertion of the attachment plate portion 185 along the extension of the discharge wire 170.

The plurality of linear protrusions in the staggered arrangement respectively apply abutment pressures to the attachment portion 185 held by the brush holder 156 alternately from the front and rear faces thereof. Therefore, the attachment portion 185 is waved as indicated by a phantom line with a little exaggeration in FIG. 8. Thus, the strength of the base 181 along the length thereof is increased, and the brush material 182 can be uniformly urged into contact with the peripheral surface of the photoreceptor 41. Hence, the paper dust collecting brush 43 can efficiently brush away paper dust adhering onto the surface of the photoreceptor 41.

Although the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application is based on a patent application No. 8-56495 filed in Japan, the entire disclosure of which is incorporated hereinto by reference.

What is claimed is:

1. A charging device comprising:

a pair of support members spaced apart at a predetermined distance;

a discharge wire having first and second opposing ends and a middle portion therebetween, said wire being stretched between the pair of support members with the first end thereof being fixed to one of the support members and with the middle portion thereof being supported by the other support member;

a coil spring for applying a tension to the discharge wire, one end thereof being connected to the second end of the discharge wire;

an electrode having a hooking portion for receiving the other end of the coil spring;

an electrode fixing member for fixing the electrode in the vicinity of the other support member; and a charging device frame having a charger arrangement frame in which the discharge wire, the coil spring and the electrode are disposed, and having a brush holder to which a brush member is attachable, the charger arrangement frame and the brush holder being integrally formed in an adjoining relation, and the brush holder having a retention space for receiving an attachment plate portion of the brush member, the brush holder further having a plurality of linear protrusions facing the retention space, extending parallel to a direction of an insertion of the attachment plate portion, and being arranged across the direction of the insertion of the attachment plate portion along an extension of the discharge wire.

2. A charging device as set forth in claim 1, wherein the electrode fixing member includes at least one electrode fixing plate provided on a bottom of the frame, the electrode fixing plate having an opening, and wherein the electrode is a discrete component, and has a base portion abutting against the electrode fixing plate and an insertion portion provided upright on the base portion and inserted into the opening, the insertion portion having the hooking portion at a tip thereof.

3. A charging device as set forth in claim 2, wherein the at least one electrode fixing plate comprises a pair of electrode fixing plates respectively provided in a vicinity of the pair of support members.

4. A charging device as set forth in claim 3, wherein the pair of support members are respectively provided upright on edges of the electrode fixing plates.

5. A charging device as set forth in claim 1, wherein the electrode fixing member fixes the electrode on the charging device frame so that the middle portion of the discharge wire is pressed onto the other support member.

* * * * *